US005771619A

United States Patent [19]

Wells

[11] Patent Number: 5,771,619

[45] Date of Patent: Jun. 30, 1998

[54] SURFACE-MOUNTED DISPLAY DEVICE

[76] Inventor: Timothy E. Wells, 4703 Halen St., Palmdale, Calif. 93552

[21] Appl. No.: 718,647

[22] Filed: Sep. 27, 1996

Related U.S. Application Data

[63] Continuation of Ser. No. 383,970, Feb. 6, 1995, abandoned.

[51] Int. Cl.[6] ..... G09F 21/04

[52] U.S. Cl. ..... 40/643; 40/649

[58] Field of Search ..... 40/642.02, 643, 40/649, 661, 6, 611, 594, 490, 765, 593, 653, 654, 654.01, 537; 206/449, 555

[56] References Cited

U.S. PATENT DOCUMENTS

| | | | |
|---|---|---|---|
| 758,088 | 4/1904 | Mixer | 40/611 |
| 1,288,395 | 12/1918 | Duncan | 40/649 X |
| 1,827,167 | 10/1931 | Regan | 40/611 |
| 2,981,408 | 4/1961 | Gamble | 206/555 |
| 3,826,026 | 7/1974 | Bevan . | |
| 4,270,290 | 6/1981 | Eckert | 40/537 X |
| 4,305,497 | 12/1981 | Pacilio | 40/642 X |
| 4,453,328 | 6/1984 | Connolly | 40/591 |
| 4,502,188 | 3/1985 | Kohli | 40/490 X |
| 4,707,939 | 11/1987 | Bonner et al. | 40/591 |
| 4,729,183 | 3/1988 | Tarter et al. | 40/642 X |
| 4,884,353 | 12/1989 | Taylor | 40/611 |
| 4,955,153 | 9/1990 | Albrecht et al. | 40/661 |
| 5,077,925 | 1/1992 | Herrera et al. | 40/642 |
| 5,209,004 | 5/1993 | Kirlin | 40/654.01 |
| 5,241,768 | 9/1993 | Thompson | 40/661 |
| 5,442,873 | 8/1995 | Vogler | 40/649 |
| 5,471,794 | 12/1995 | Nishioka | 40/611 X |

FOREIGN PATENT DOCUMENTS

| | | | |
|---|---|---|---|
| 2167590 | 5/1986 | United Kingdom | 40/649 |

*Primary Examiner*—Brian K. Green
*Assistant Examiner*—Andrea Chop
*Attorney, Agent, or Firm*—Robert Louis Finkel

[57] ABSTRACT

The opposed side walls and connecting end walls of this surface-mounted holder can be configured in virtually any desired shape to define a window conforming to a resiliently flexible sheet bearing a display. Inserted into the holder through an opening in one of the end walls, the display sheet is guided by a ramp into sliding engagement with a pair of slots formed in the side walls at a distance from the opening. A shoulder formed on the end wall adjacent said opening in alignment with the slots abuts the end of the display sheet and retains the display sheet in the holder. Adhesive strips are provided for securing the holder to a surface, such as the bumper of an automobile.

12 Claims, 1 Drawing Sheet

SURFACE-MOUNTED DISPLAY DEVICE

This is a continuation of application Ser.No. 08/383970 filed on Feb. 06,1995, now abandoned.

BACKGROUND OF THE INVENTION

1. Field of the Invention This invention relates to display holders, and more particularly to holders for mounting replaceable displays on selected surfaces, such as automobile bumpers.

2. Prior Art

The many uses and advantages of an easily applied surface-mounted holder for replaceable or temporary displays, such as bumper stickers, bulletins, identification indicia, advertising materials and the like, are well known. Such holders take a variety of forms. Typically, the display is applied to the surface of a backing sheet or plate which, in turn, is held by a bracket or housing mounted adhesively to the surface. One form of bumper sticker replacement bracket is illustrated in U.S. Pat. No. 4,707,939. In this type of holder, a generally rigid sticker holding plate is retained in a recess in the face of a backing plate by means of clips. Brackets of this type are relatively costly to fabricate, and in use the clips are sometimes difficult to manipulate and have a tendency to deteriorate with wear and exposure to the elements.

A second type of holder is shown in U.S. Pat. No. 3,826,026. These devices employ a transparent, generally resilient pouch in place of the rigid backing plate for holding the display. The pouch is neither attractive nor durable. More significantly, the nature of its construction makes inserting and removing the display difficult, and with age and exposure, nearly impossible.

A third class of holder is depicted in U.S. Pat. No. 5,077,925. In these devices, the message-bearing sheet is sandwiched between a resilient backing pad and a transparent "window panel" carried by a pair of slots in the frame walls. With only friction to retain it, the display sheet is subject to shifting within the frame. This problem becomes increasingly serious with age, as the backing material loses its resiliency.

Because of their utility, the development of surface-mounted display devices has been active and extensive. It has not been limited to the construction of the display holder. As seen in U.S. Pat. No. 4,453,328, consideration has been given to such features as providing means for adjusting the orientation of the display with respect to the mounting surface. Despite all of these efforts, however, no single mounting assembly has been produced which avoids the deficiencies inherent in the prior art.

Viewed against this background, one object of the subject invention is to provide a surface-mounted display device which affords the advantages and overcomes the deficiencies inherent in prior art display holders.

Another object is to provide a surface-mounted display holder which is sturdy, lightweight, and durable, yet relatively inexpensive to fabricate.

Yet another object is to provide a display holder which allows the display to be inserted and withdrawn quickly and easily while the holder is mounted to a surface.

An additional object is to provide a surface-mounted holder which can be used with a variety of display formats.

Another object is to provide a surface-mounted holder construction which can be adapted for use with displays applied on, or affixed to, a resilient backing sheet in relief.

Still another object is to provide a surface-mounted holder construction which can be adapted for use with displays of various shapes.

A further object is to provide a display holder of this type which allows its use to be restricted to displays of selectively predetermined shapes.

Other objects will become apparent from the following summary of the invention and detailed description of its preferred embodiments.

SUMMARY OF THE INVENTION

In its presently preferred form, the subject invention comprises a holder and a resiliently flexible sheet bearing the display. The opposed side walls of the holder are joined at their ends by integral end walls. In fabrication the walls can be configured to form a framework, much like a picture frame, of virtually any desired shape and aesthetic style. The frame is intended to conform to the plan shape of a preselected display sheet and defines a window through which the display can be viewed. A common base, formed integrally with the walls, serves as a bottom for attaching the holder to an underlying surface by means such as adhesive strips, or the like.

One end of the holder is provided with an opening sized and shaped for receiving the display sheet. A pair of slots are formed in the side walls with their ends spaced from the opening. A ramp formed in the floor of the base extends from the throat of the opening to the ends of the slots in the side walls and guides a display sheet inserted through the opening into sliding engagement with the slots.

A shoulder is formed on the end wall adjacent the opening and in alignment with the slots. When the resilient display sheet has been fully inserted through the opening, the shoulder abuts its trailing end and retains the display sheet in engagement with the slots.

In one alternative embodiment, the holder is formed without a base and is attached to the supporting surface by adhesive strips applied to the edges of the walls. The ramp, positioned in alignment with the opening as in the previously described embodiment, is supported by the side walls. In another, rather than slots in the walls for engaging the edges of the display sheet, the walls are provided with upstanding flanges and the edges of the display sheet are formed with grooves adapted for engagement with the flanges.

For a fuller understanding of the invention and its various modifications and applications, reference is made to the following detailed description of the preferred embodiments illustrated in the accompanying drawings, in which:

BRIEF DESCRIPTION OF THE DRAWINGS

Wherever practicable, the same numeral is used to identify identical or substantially similar features appearing in the several figures.

DETAILED DESCRIPTION OF THE PREFERRED EMBODIMENTS

Figures 1, 2, 3, 4, 5, 6, 7, 8, 9, 10:
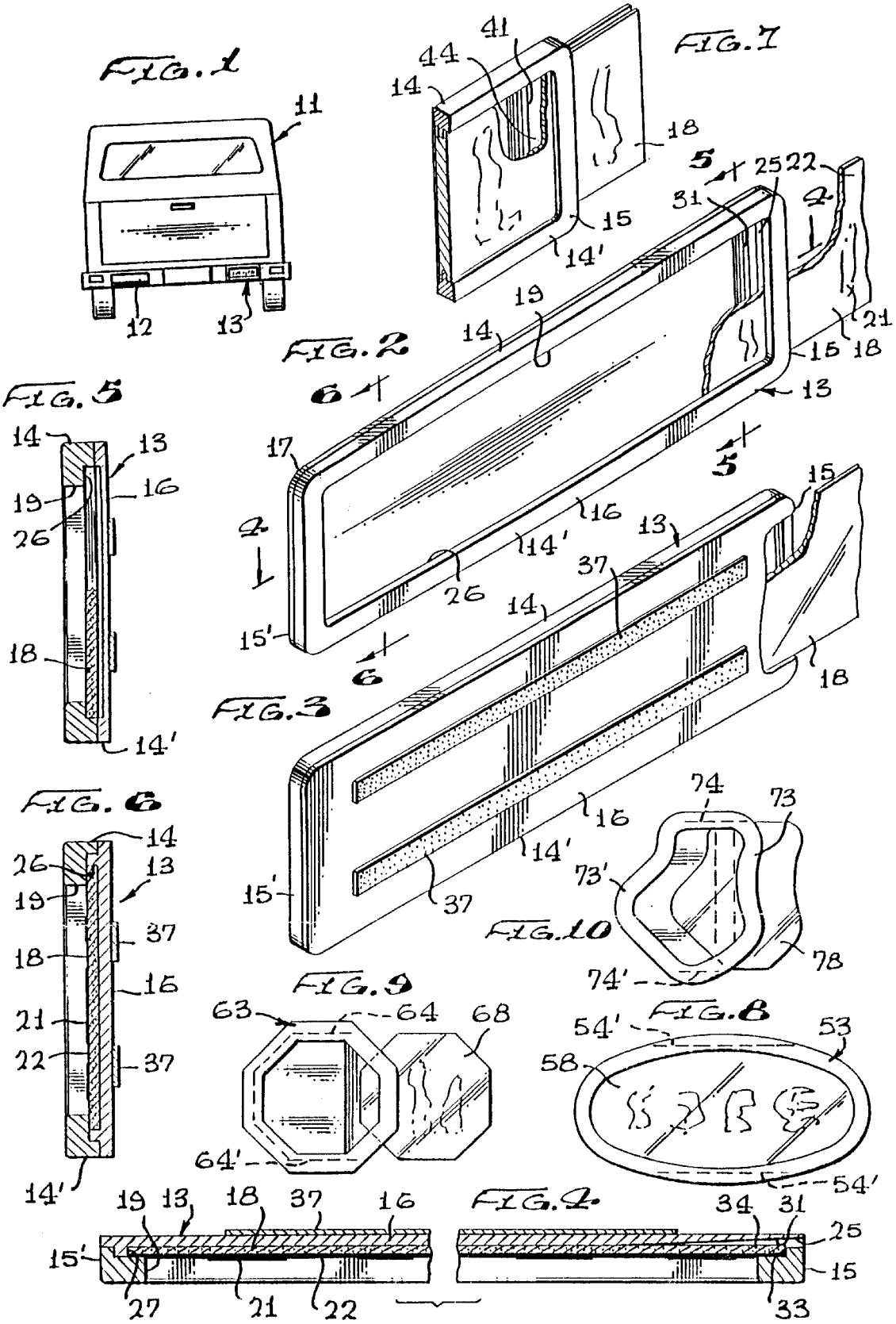
FIG. 1 is a fanciful rear elevational view of an automobile, showing a conventional bumper sticker affixed to its bumper and the same bumper sticker displayed in a display device embodying the subject invention.
FIG. 2 is an enlarged, top frontal perspective view of a display device, such as that shown in FIG. 1, with portions cut away to expose its construction and with a fragmentary display sheet partially inserted to illustrate its operation.
FIG. 3 is a top rear perspective view of the device and fragmentary display sheet shown in FIG. 2.
FIG. 4 is an enlarged, broken sectional view of the device shown in FIG. 2, taken along the line 4—4.
FIG. 5 is an enlarged sectional view of the device and fragmentary display sheet shown in FIG. 2, taken along the line 5—5.
FIG. 6 is an enlarged sectional view of the device shown in FIG. 2, with the display sheet fully inserted, taken along the line 6—6.
FIG. 7 is a fragmentary top frontal perspective of an alternative embodiment of the device of FIG. 2.
FIG. 8 is a frontal elevational view of an alternatively shaped display and display device in accordance with the subject invention.
FIG. 9 is a frontal elevational view of another alternatively shaped display and display device in accordance with the subject invention.
FIG. 10 is a frontal elevational view of yet another alternatively shaped display and display device in accordance with the subject invention.

Referring to FIG. 1, while the rear end of a vehicle, such as automobile 11 may be the logical billboard for a colorful bumper sticker 12 celebrating a recent trip to the mountains or shore, as anyone who has ever had to scrape and scrub gum-like adhesive from a trunk lid or bumper will attest, the celebration is usually not worth the effort. With a display holder 13 embodying the subject invention, however, a whole Summer's-worth of stickers can be displayed and replaced almost effortlessly.

The holder 13 illustrated in FIGS. 1–6 can be fabricated of metal, plastic, or other suitable materials by conventional methods. In the rectangular configuration shown, it includes a pair of parallel side walls 14, 14' connected integrally by parallel end walls 15, 15' and, with end walls 15, 15', joined integrally to a base 16. Walls 14, 14', 15, and 15' effectively represent the frame 17 referred to earlier, and, like a conventional picture frame, can have any desired form and surface appearance. By way of a few random examples, the walls' faces may be flat, or curved, or "L"-shaped, and their surfaces may be smooth, or fluted, or ornately embossed. The frame 17 serves to support and retain a display sheet 18, and defines a window 19 for exposing a 2-or 3-dimensional display 21 on the sheet's surface 22.

An opening 25 is formed in end wall 15 to receive display sheet 18. The display 21 may be applied directly to the surface 22, for example, by silk screening, or it may be created independently and furnished on a separate backing which can then be affixed to the surface 22 by an appropriate adhesive, or the like.

A pair of guides adapted for sliding engagement with the outer edges of display sheet 18, in this embodiment slots 26, are formed in the opposed side walls 14, 14' and spaced from end wall 15. Optionally, for further support of display sheet 18 and a more finished appearance, a similar slot 27 may be provided in end wall 15' in registry with the adjacent ends of slots 26. It will be noted that regardless of the plan form of frame 17, as long as opposed portions of slots 26 are substantially parallel and lie substantially in a common plane, the construction of the invention will support display sheets of a broad variety of shapes.

A ramp 31 is formed in the floor of base 16 in alignment with the opening 25. Ramp 31 is designed to intercept a display sheet 18 inserted into the holder 13 through opening 25, and direct it toward, and on further insertion, into engagement with, the adjacent ends of slots 26.

A shoulder 33 formed at the edge of opening 25 in end wall 15 in alignment with slots 26 deflects display sheet 18 out of alignment with slots 26 and imparts an increasing torque between slots 26 and display sheet 18 as the latter is thrust more deeply into opening 25. Upon clearing shoulder 33, the natural resilience of display sheet 18 causes the trailing end 34 of display sheet 18 to snap into alignment with slots 26, and, thus, into abutment with shoulder 33. Unless and until sufficient force is exerted to displace the end 34 of sheet 18 out of alignment with shoulder 33, an event not likely to occur in driving, even on very rough surfaces, shoulder 33 will retain sheet 18 in engagement with slots 26.

When it is desired to replace the display sheet 18, its removal is a simple matter of applying force normally against sheet 18 close to end wall 15 to disengage end 34 from shoulder 33, and using finger-tip friction with the surface of sheet 18 to slip sheet 18 out of the holder 13.

By virtue of the aforementioned novel construction, the display sheet can be inserted and withdrawn readily, even when the holder is mounted to a surface. FIG. 7 discloses a modification incorporating this feature in a holder in which a low silhouette is desired. In this embodiment, the base 16 terminates at the leading edge of ramp 41, leaving a region 44 between ramp 41 and opening 25 without a floor to restrict the normal displacement of the trailing end of sheet 18.

As a further alternative, not necessarily related to the previously described modifications shown in FIG. 7, slots 26 in sidewalls 14, 14' may be replaced by flanges 42 on the opposing faces of side walls 14, 14', and the adjacent peripheral edges of display sheet 43 provided with grooves or other suitable engagement means for slidingly engaging them.

Conveniently, strips of adhesive tape 37 applied to the rear surface of base 16 serve to attach holder 13 to a surface, such as the bumper of automobile 11. Other well known attachment means, such as screws, suction clamps, cementeous materials, and the like could be used for the purpose with equally satisfactory results.

Although the illustrated holder is rectangular and is adapted to receive a similarly shaped display sheet, as mentioned earlier, the frame 17 could as easily have taken various other geometric or free-form shapes for use with display sheets of non-rectangular shape. FIGS. 8–10 illustrate several modifications of the invention which embody non-rectangular shapes. FIG. 8 depicts an oval display holder 53 having generally parallel opposed side walls 54, 54' and an oval display sheet 58. In FIG. 9, the holder 63 is octagonal and has generally parallel side walls 64, 64' adapted to receive the peripheral sides of an octaganal display sheet 68. FIG. 10 shows a free-form holder having end walls 73, 73', parallel side walls 74, 74', and conforming display sheet 78 with portions of its opposite edges 79 parallel to one another.

As shown additionally in FIG. 10, for some installations it may be advantageous to eliminate the base from the holder entirely. In this embodiment, the ramp 71 is positioned in the throat of opening 75 in end wall 73, however, it is secured directly to side walls 74, 74'.

It has been pointed that the construction and operation of the invention allow it to be used with a variety of display formats. In this regard, it should be noted that the format may be established by the design of the holder, or by the configuration of the display sheet. Thus, by way of example, an promoter can effectively limit the use of its display holders to its selected customers by producing the holders in a unique shape adapted to accept only displays that it publishes on display sheets of that shape. Alternatively, a publicist can offer its customers the ability to display print and graphic materials from other sources which publish in a unique, standardized format by furnishing them holders designed for use with display sheets of that shape.

From the foregoing description, the advantages afforded by the novel features of the subject invention will be readily apparent. It should be understood, however, that while the invention has been described in terms of the constructions shown in the drawings and certain exemplary modifications thereof, it is not to be construed as limited to those embodiments. They are to be regarded as illustrative rather than restrictive. The invention encompasses any and all variations of the examples chosen for purposes of the disclosure, which do not depart from the spirit and scope of the following claims.

What is claimed is:

1. A surface-mounted holder for a resilient, flexible display sheet having a surface bearing a display, said holder comprising:

opposed side walls joined by end walls to define a window exposing the display;

an opening through one of the end walls for insertion of a display sheet into said holder;

guides associated with said side walls for slidingly retaining the opposite edges of a display sheet, said guides being spaced inwardly of and offset from said opening;

a floor including an inclined ramp leading from said opening to said guides;

a shoulder formed on one of said end walls in confronting alignment with said guides for blocking motion of the display sheet in the direction of said opening, said shoulder being spaced from said floor for allowing the display sheet to pass through the opening, whereby the display sheet is capable of being readily displaced from confronting alignment with said shoulder by the application of force against the surface of the display sheet; and attachment means for mounting said holder to a supporting surface.

2. A holder in accordance with claim 1, wherein said guides are slots in said side walls for insertably receiving the opposite edges of said display sheet.

3. A holder in accordance with claim 1, wherein said guides are flanges formed on said side walls insertable into slots provided at the edges of said display sheet.

4. A holder in accordance with claim 1, wherein said attachment means are adhesive.

5. A display assembly, comprising:

a resilient, flexible display sheet having a surface bearing a display; and a surface-mounted holder for said display sheet, said holder having:

opposed side walls joined by end walls to define a window exposing the display;

an opening through one of the end walls for insertion of said display sheet into said holder;

guides associated with said side walls, said guides slidingly retaining opposite edges of said display sheet, said guides being spaced inwardly of and offset from said opening;

a floor including an inclined ramp leading from said opening to said guides;

a shoulder formed on one of said end walls in confronting alignment with said guides and normally blocking motion of the display sheet in the direction of said opening, said shoulder being spaced from said floor a distance greater than the thickness of the display sheet, whereby the display sheet is readily displaced from confronting alignment with said shoulder by the application of force against the surface of the display sheet; and attachment means for mounting said holder to a supporting surface.

6. A display assembly in accordance with claim 5, wherein said guides are slots in said side walls insertably receiving the opposite edges of said display sheet.

7. A display assembly in accordance with claim 5, wherein said guides are flanges formed on said side walls insertable into slots provided at the opposite edges of said display sheet.

8. A display assembly in accordance with claim 5, wherein said attachment means are adhesive.

9. In combination:

a surface-mounted holder for a resiliently flexible display sheet having a surface bearing a display, said holder comprising:

opposed side walls joined by end walls to define a window exposing the display;

an opening through one of the end walls for insertion of a display sheet into said holder;

guides associated with said side walls for slidingly retaining opposite edges of the display sheet, said guides being spaced inwardly of and offset from said opening;

a floor including an inclined ramp leading from said opening to said guides;

a shoulder formed on one of said end walls in confronting alignment with said guides for blocking motion of the display sheet in the direction of said opening, said shoulder being spaced from said floor for allowing the display sheet to pass through the opening, whereby the display sheet is capable of being readily displaced from confronting alignment with said shoulder by the application of force against the surface of the display sheet; and attachment means for mounting said holder to a supporting surface; and a vehicle.

10. A combination in accordance with claim 9, wherein said guides are slots in said side walls for insertably receiving the opposite edges of said display sheet.

11. A combination in accordance with claim 9, wherein said guides are flanges formed on said side walls insertable into slots provided at the edges of said display sheet.

12. A combination in accordance with claim 9, wherein said attachment means are adhesive.

* * * * *